US010093464B2

(12) United States Patent
Tsao

(10) Patent No.: US 10,093,464 B2
(45) Date of Patent: Oct. 9, 2018

(54) RECEIVING BOX

(71) Applicant: PEGATRON CORPORATION, Taipei (TW)

(72) Inventor: Wei-Chun Tsao, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 64 days.

(21) Appl. No.: 15/053,811

(22) Filed: Feb. 25, 2016

(65) Prior Publication Data

US 2016/0332787 A1 Nov. 17, 2016

(30) Foreign Application Priority Data

May 13, 2015 (TW) ..... 104207315 U

(51) Int. Cl.

| | |
|---|---|
| ***B65D 55/02*** | (2006.01) |
| ***B65D 5/68*** | (2006.01) |
| ***B65D 43/00*** | (2006.01) |
| ***B65D 43/02*** | (2006.01) |

(52) U.S. Cl.

CPC ..... *B65D 55/02* (2013.01); *B65D 5/68* (2013.01); *B65D 43/00* (2013.01); *B65D 43/02* (2013.01)

(58) Field of Classification Search

CPC ..... B65D 55/02; B65D 43/02; B65D 43/00; B65D 5/68

USPC ..... 220/784, 786, 788, 799

See application file for complete search history.

(56) References Cited

U.S. PATENT DOCUMENTS

| | | | | | |
|---|---|---|---|---|---|
| 2,186,777 | A * | 1/1940 | Best | B65D 5/10 | 229/125.37 |
| 3,244,355 | A * | 4/1966 | Nolen | B65D 5/10 | 229/157 |
| 4,776,459 | A * | 10/1988 | Beckerman | B65D 43/0214 | 206/467 |
| 5,048,707 | A * | 9/1991 | Hallberg | A21B 3/133 | 220/324 |
| 6,666,348 | B2 * | 12/2003 | Fore | B65D 1/26 | 220/315 |

(Continued)

FOREIGN PATENT DOCUMENTS

| | | | | |
|---|---|---|---|---|
| GB | 984593 | A * | 2/1965 | B65D 43/0237 |
| TW | 200927604 | A * | 7/2009 | |

(Continued)

*Primary Examiner* — James N Smalley

(74) *Attorney, Agent, or Firm* — Muncy, Geissler, Olds & Lowe, P.C.

(57) ABSTRACT

A receiving box comprises a cover and a base. The cover comprises a first slit, a first connection part and a top surface. The first slit and the first connection part are respectively disposed at opposite sides of the top surface. The base comprises a first convex portion comprising two first bending parts and a first link part, and a second convex portion. The first convex portion is correspondingly disposed at the first slit. The second convex portion is correspondingly disposed at the first connection part. Two first bending parts are respectively located on opposite sides of the first link part. When the cover combines with the base, the second convex portion inserts into the first connection part, the first convex portion inserts into the first slit, the two first bending parts bend to contact the top surface. Thus, the cover firmly attaches to the base.

3 Claims, 4 Drawing Sheets

(56) References Cited

U.S. PATENT DOCUMENTS

| | | | | |
|---|---|---|---|---|
| 2005/0082293 | A1* | 4/2005 | Nordland | B65D 1/22 220/324 |
| 2006/0191947 | A1* | 8/2006 | Jedryk | B65D 43/0222 220/788 |
| 2014/0299603 | A1* | 10/2014 | Joy | A47J 36/00 220/324 |

FOREIGN PATENT DOCUMENTS

| | | | |
|---|---|---|---|
| TW | I331120 | B | 10/2010 |
| TW | M493525 | U * | 1/2015 |

* cited by examiner

RECEIVING BOX

CROSS REFERENCE TO RELATED APPLICATIONS

This Non-provisional application claims priority under 35 U.S.C. § 119(a) on Patent Application No(s). 104207315 filed in Taiwan, Republic of China on May 13, 2015, the entire contents of which are hereby incorporated by reference.

BACKGROUND

1. Technology Field

The disclosure relates to a receiving box, and particularly to a receiving box utilizing convex portions of a base for engaging with a cover to ensure that the cover firmly attaches to the base when the receiving box is impacted by external forces.

2. Description of the Related Art

Generally speaking, various kinds of receiving boxes are available on the market. For example, a receiving box with a separate cover has a cover designed to directly cover the main body of the receiving box for engagement between the two. However, the disadvantage of the abovementioned combining method is that the engagement between the cover and the box main body is not sufficiently strong to withstand an external impact. When the receiving box is impacted by external forces, the cover disengages from the main box body easily, which may allow the objects stored within the box to be damaged and may cause inconvenience to the user. Accordingly, it is desired to improve the design to address the above-mentioned issue.

SUMMARY

The objective of the present invention is to provide a receiving box having a cover that combines with the base via convex portions to assure that the cover does not disengage from the base when the receiving box is impacted by external forces.

In order to achieve the above-mentioned objective, the receiving box comprises a cover and a base. The cover comprises a first slit, a first connection part and a top surface. The first slit and the first connection are partly and respectively disposed on opposite sides of the top surface. The base comprises a first convex portion and a second convex portion. The first convex portion is disposed corresponding to the first slit, and the second convex portion is disposed corresponding to the first connection part. The first convex portion comprises two first bending parts and a first link part. The first bending parts are respectively located on the two sides of the first link part. When the cover combines with the base, the second convex portion inserts into the first connection part, the first convex portion inserts into the first slit, and two first bending parts bend to contact the top surface.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Embodiments are provided in the following in order to further describe in detail the implementations of the present invention. It should be noted that the objects used in the diagrams of the embodiments are provided with proportions, dimensions, deformations, displacements and details as examples and that the present invention is not limited thereto; also to be noted is that identical components in the embodiments are given the same component numbers.

Figure 1:
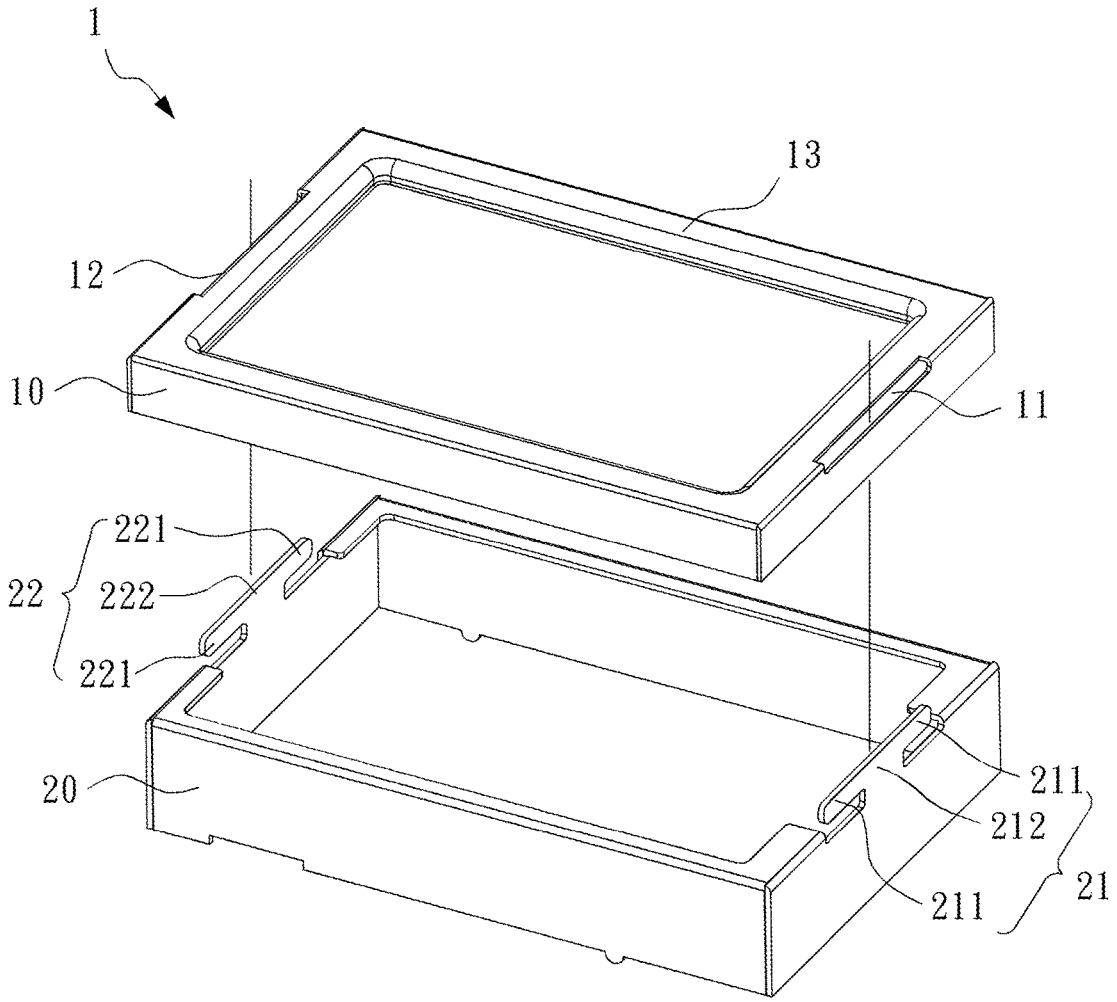
FIG. 1 is an exploded schematic diagram of a first embodiment of the receiving box of the present invention.
Figure 2:
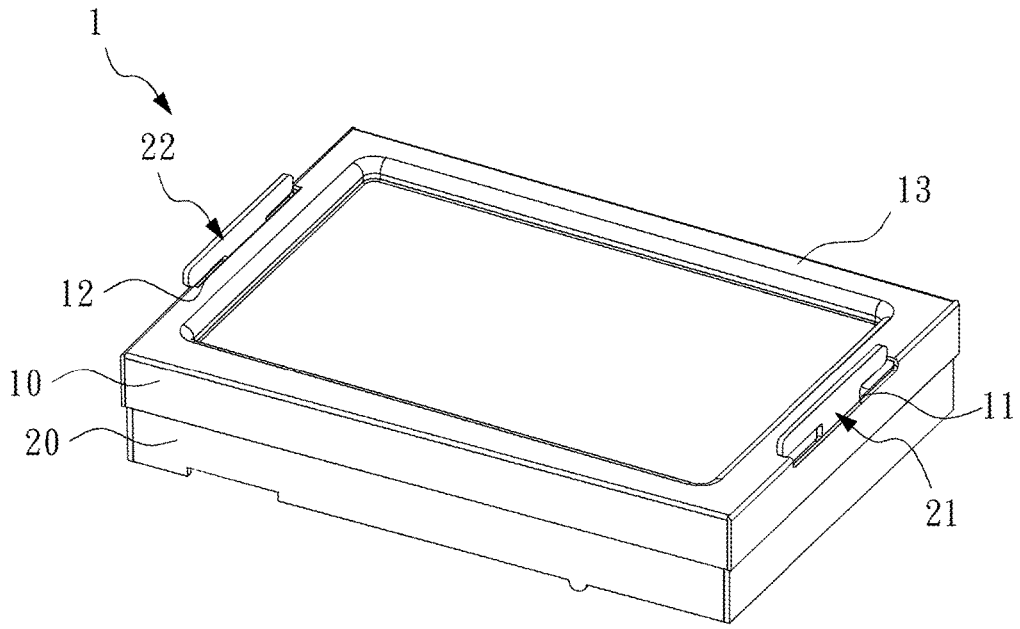
FIG. 2 and FIG. 3 are operating diagrams of the cover combining with the base according to the first embodiment.
Figure 3:
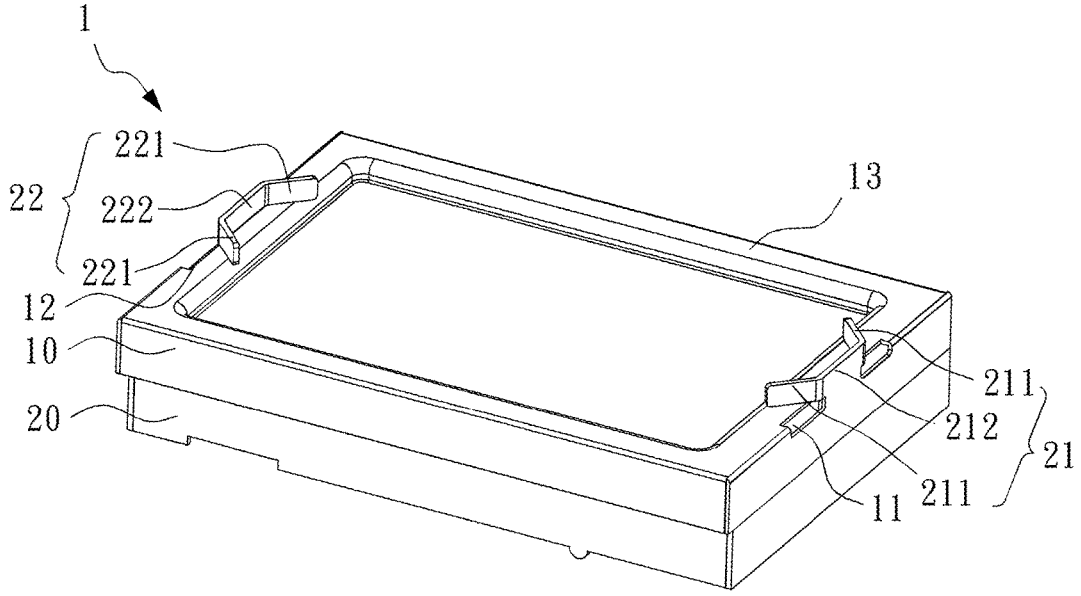

Please refer to FIG. 1 to FIG. 3. FIG. 1 is an exploded schematic diagram of a first embodiment of the receiving box of the present invention, and FIG. 2 and FIG. 3 are operating diagrams of the cover combining with the base according to the first embodiment. According to an embodiment of the present invention, the receiving box 1 is a metal mask used for the surface mount technology (SMT) process of electronic components, but the scope of the invention is not limited thereto.

As shown in FIG. 1, the receiving box 1 comprises a cover 10 and a base 20. In the first embodiment, the cover 10 is rectangular in shape and comprises a first slit 11, a first connection part 12, and a top surface 13. The first slit 11 and the first connection part 12 are individually disposed on the two short sides of the top surface 13. The base 20 is integrally formed and comprises a first convex portion 21 and a second convex portion 22. The first convex portion 21 is disposed corresponding to the first slit 11, and the second convex portion 22 is disposed corresponding to the first connection part 12. It is noted that, as shown in the embodiment illustrated in FIGS. 1-3, the structure of the second convex portion 22 is identical to the structure of the first convex portion 21; the slit structure of the first connection part 12 is identical to the first slit 11.

In the first embodiment shown in FIG. 1, the first convex portion 21 comprises two first bending parts 211 and a first link part 212. The two first bending parts 211 are respectively located at the two opposite sides of the first link part 212. When the two first bending parts 211 are not bent, the appearance of the first convex portion 21 is T-shaped. In this first embodiment, the structure of the second convex portion 22 and the structure of the first convex portion 21 are identical. Therefore, the second convex portion 22 comprises the two second bending parts 221 and the second link part 222, and the two second bending parts 221 are respectively located on opposite sides of the second link part 222 such that the appearance of the second convex portion 22 is also T shaped.

As shown in FIG. 2, when the cover 10 combines with the base 20, the first convex portion 21 passes through the first slit 11, the second convex portion 22 passes through the first connection part 12, and the first convex portion 21 and the second convex portion 22 are exposed on the top surface 13. As shown in FIG. 3, the two first bending parts 211 and the two second bending parts 221 are bent respectively towards the cover 10 such that the lower edges of the two first bending parts 211 and the lower edges of the two second bending parts 221 respectively contact the top surface 13. The cover 10 firmly attaches to the base 20 via the engagement forces generated by the lower edges of the two first bending parts 211 and the lower edges of the two second bending parts 221 contacting the top surface 13. Thus when the receiving box 1 is impacted by external forces, the cover 10 does not detach from the base 20.

Figure 4:
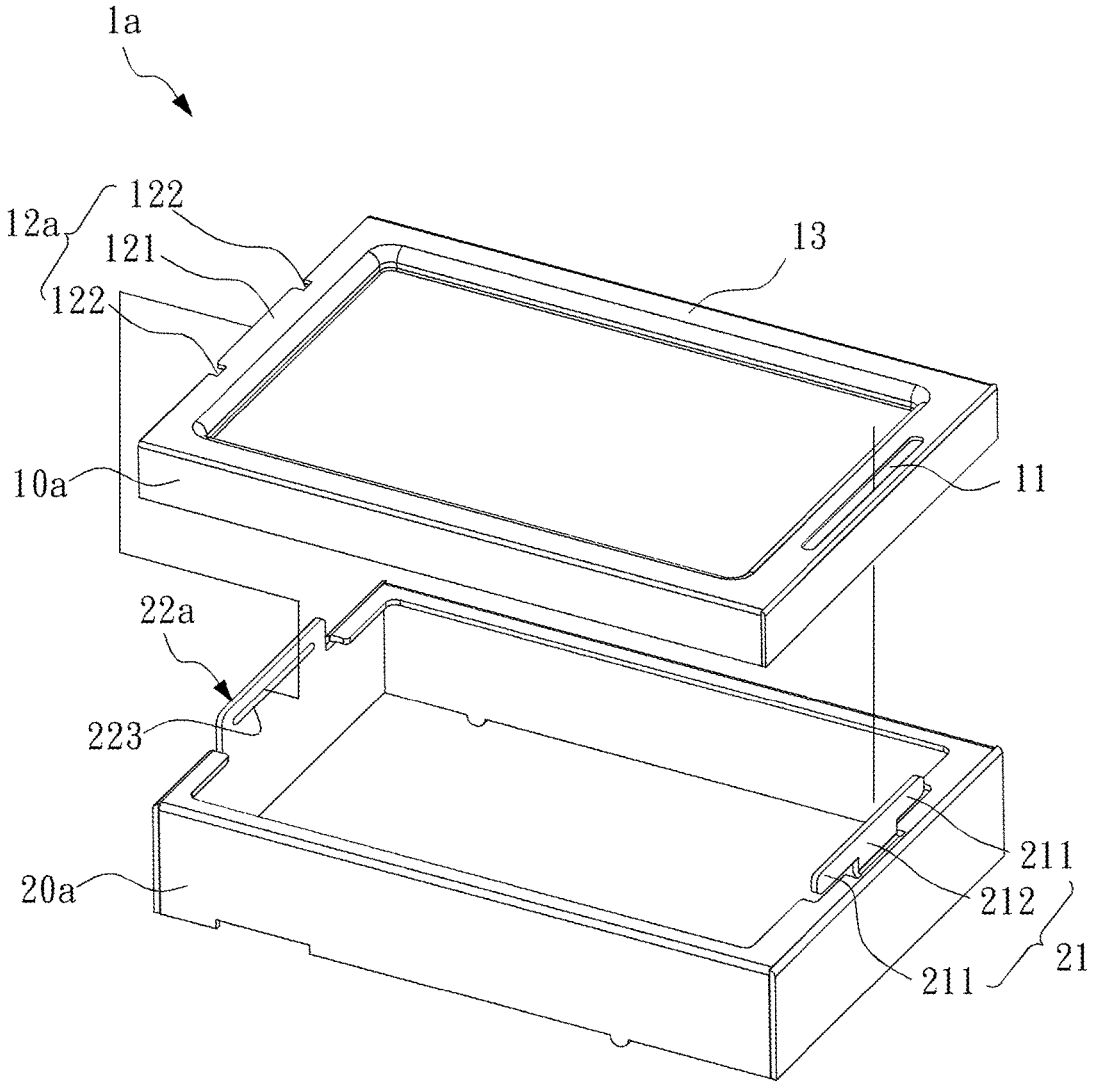
FIG. 4 is an exploded schematic diagram of a second embodiment of the receiving box of the present invention.
Figure 5:
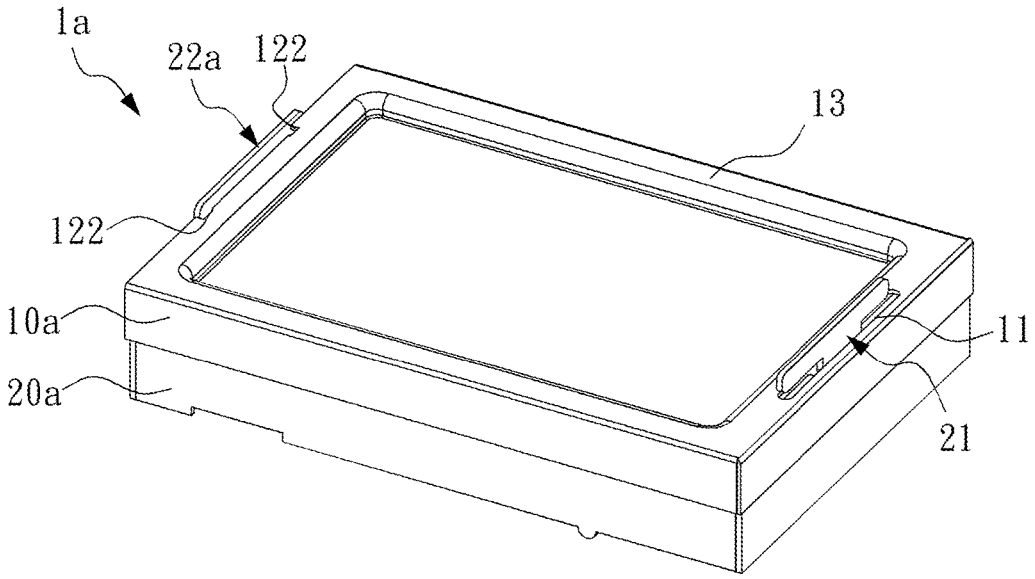
FIG. 5 and FIG. 6 are operating diagrams of the cover combining with the base according to the second embodiment.
Figure 6:
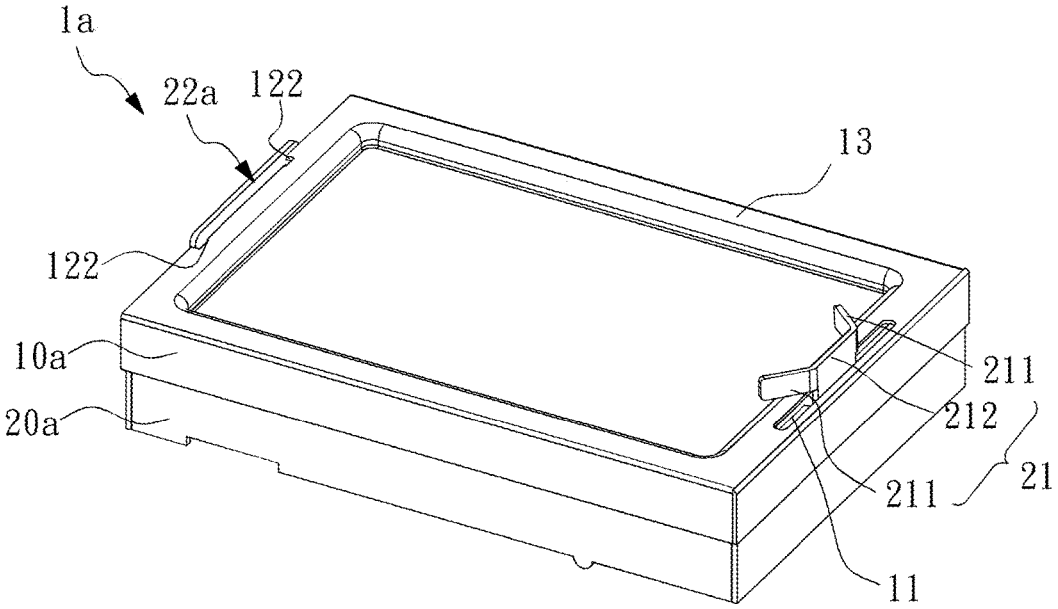

Please refer to FIG. 4 to FIG. 6. FIG. 4 is an exploded schematic diagram of a second embodiment of the receiving box of the present invention, and FIG. 5 and FIG. 6 are operating diagrams of the cover combining with the base according to the second embodiment.

The difference between the second embodiment and the first embodiment is the structure of the first connection part 12*a* and the structure of the second convex portion 22*a*. As shown in FIG. 4, the first connection part 12*a* comprises a third convex portion 121 and two rabbets 122. The two rabbets 122 are respectively disposed on opposite sides of a third convex portion 121. The second convex portion 22*a* is rectangular in shape. The second convex portion 22*a* comprises a second slit 223. As shown in FIG. 5, when a cover 10*a* combines with a base 20*a*, the third convex portion 121 is inserted into the second slit 223. At the same time, a part of the second convex portion 22*a* inserts the two rabbets 122, and then the first convex portion 21 passes through the first slit 11 such that the first convex portion 21 is exposed on the top surface 13 to form the status shown in FIG. 5. At this point, as shown in FIG. 6, the two first bending parts 211 are bent towards the cover 10*a* such that the lower edges of the two first bending parts 211 contact the top surface 13. The cover 10*a* firmly attaches to the base 20*a* due to the engagement forces generated by the lower edges of the two first bending parts 211 contacting the top surface 13 and the engagement forces of the first connection part 12*a* and the second convex portion 22*a*. Thus when the receiving box 1*a* is impacted by external forces, the cover 10*a* does not detach from the base 20*a*.

Because of the design of the first convex portion 21 being inserted into the first slit 11 and the second convex portion 22 being inserted into the first connection part 12, the covers 10, 10*a* firmly attach to the bases 20, 20*a*. If the receiving boxes 1, 1*a* are impacted by external forces, the covers 10, 10*a* will not detach from the bases 20, 20*a*.

While the present invention has been particularly shown and described with reference to a preferred embodiment, it will be understood by those skilled in the art that various changes and modifications can be made to the described embodiments. It is to be understood that many other possible modifications and variations can be made without departing from the spirit and scope of the invention as hereinafter claimed.

What is claimed is:

1. A receiving box, comprising:

a cover, comprising a first slit, a first connection part and a top surface, the first slit and the first connection part respectively disposed on opposite sides of the top surface; and a base, comprising a first convex portion and a second convex portion, the first convex portion disposed corresponding to the first slit, the second convex portion disposed corresponding to the first connection part, the first convex portion comprising two first bending parts and a first link part, wherein the two first bending parts are respectively located on two opposite sides of the first link part, the second convex portion is inserted into the first connection part, the first convex portion is inserted into the first slit, the two first bending parts are bent towards the cover and contact the top surface, and the first link part is not bent when the cover combines with the base;

wherein the second convex portion comprises a second slit, and the first connection part comprises a third convex portion, wherein the third convex portion inserts into the second slit when the cover combines with the base.

2. The receiving box as claimed in claim 1, wherein the first connection part comprises two rabbets, the two rabbets are respectively disposed on the two sides of the third convex portion, wherein the third convex portion inserts into the second slit, and a part of the second convex portion respectively connects with the two rabbets when the cover combines with the base.

3. The receiving box as claimed in claim 1, wherein when the two first bending parts are not bent, the first convex portion is T-shaped.

* * * * *